United States Patent [19]

Davis et al.

[11] 4,133,758

[45] Jan. 9, 1979

[54] GRAVITY SETTLING

[75] Inventors: Hymen R. Davis, Glenridge; R. H. Long, Morristown; A. A. Simone, Dover, all of N.J.

[73] Assignee: The Lummus Company, Bloomfield, N.J.

[21] Appl. No.: 835,498

[22] Filed: Sep. 22, 1977

Related U.S. Application Data

[63] Continuation-in-part of Ser. No. 720,686, Sep. 7, 1976, abandoned.

[51] Int. Cl.[2] ..... B01D 21/02

[52] U.S. Cl. ..... 210/83; 210/521; 210/522; 210/537; 210/538

[58] Field of Search ..... 210/83, 84, 305, 320, 210/532, 515, 521, 522, 534, 251, 513, 537, 538, 73 R, 73 OW, 242

[56] References Cited

U.S. PATENT DOCUMENTS

| | | | |
|---|---|---|---|
| 1,484,953 | 2/1924 | Marsh | 210/305 |
| 1,677,324 | 7/1928 | Beck et al. | 210/305 |
| 1,820,974 | 9/1931 | Hills | 210/305 |
| 1,869,758 | 8/1932 | Lungstras | 210/521 |
| 2,056,763 | 9/1931 | Hills | 210/305 |
| 2,167,160 | 7/1939 | Raymond | 210/84 |
| 2,261,101 | 10/1941 | Erwin | 210/84 |
| 3,331,510 | 7/1967 | Arnold | 210/521 |
| 3,370,714 | 2/1968 | Trawinski | 210/521 |
| 3,494,475 | 2/1970 | Hedstrom et al. | 210/521 |
| 3,703,467 | 11/1973 | Lummus et al. | 210/522 |
| 3,752,318 | 8/1973 | DeRoven et al. | 210/522 |

FOREIGN PATENT DOCUMENTS

| | | | |
|---|---|---|---|
| 24417 | 10/1883 | Fed. Rep. of Germany | 210/521 |

*Primary Examiner*—Frank Sever
*Attorney, Agent, or Firm*—Marn & Jangarathis

[57] ABSTRACT

Solids are separated from a liquid in a gravity settler provided with inclined solid intercepting surfaces to intercept the solid settling path to coalesce the solids and increase the settling rate. The intercepting surfaces are inverted V-shaped plates, each formed from first and second downwardly inclined upwardly curved intersecting conical sections having their apices at the vessel wall.

7 Claims, 2 Drawing Figures

GRAVITY SETTLING

Figures 1, 2:
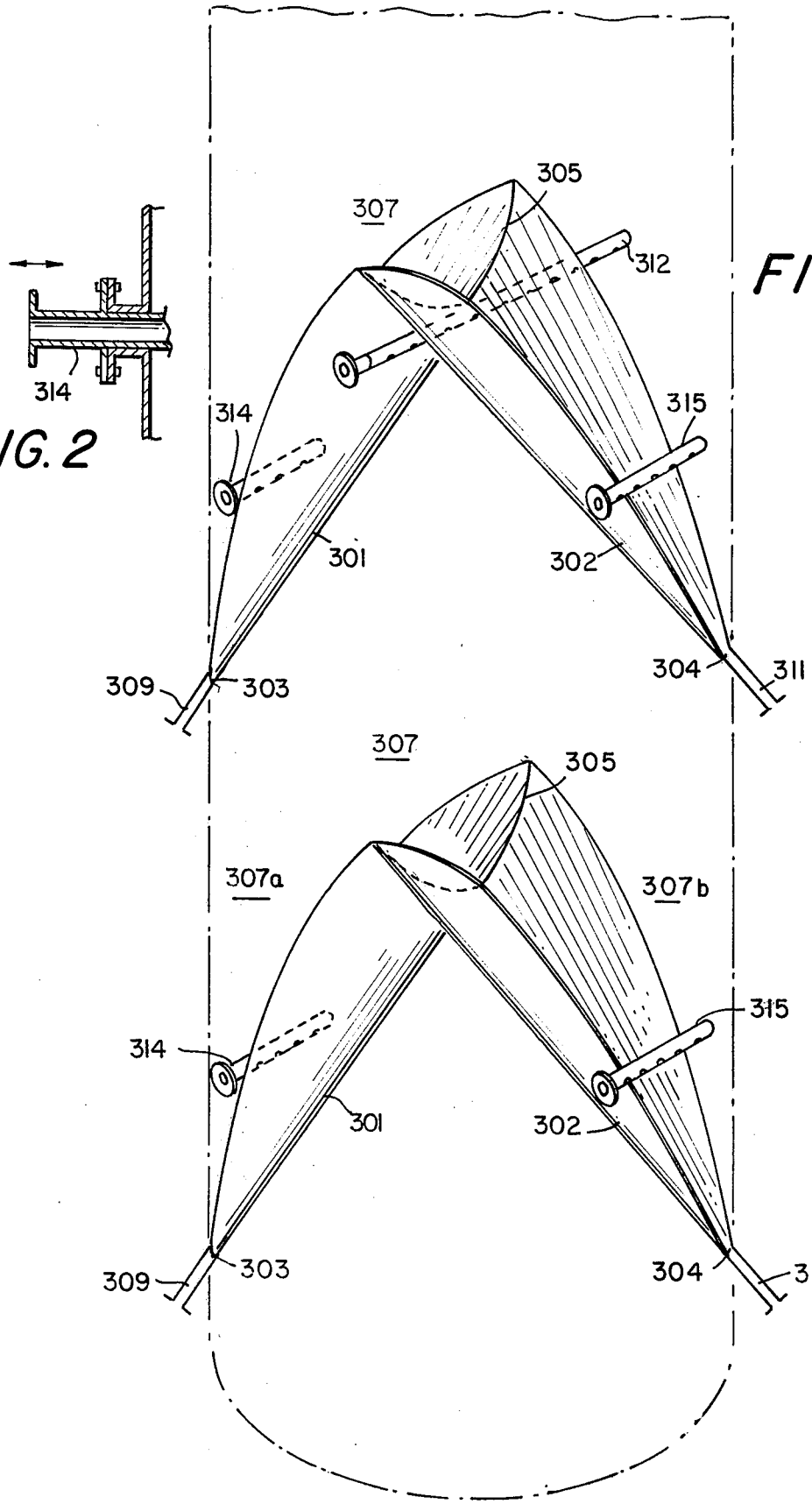

The Government of the United States of America has rights in this invention pursuant to contract number EX76-C-01-2514, awarded by the United States Energy Research and Development Administration.

This application is a continuation-in-part of U.S. application Ser. No. 720,686, filed on Sept. 7, 1976 now abandoned.

This invention relates to liquid-solid separation, and more particularly, to liquid-solid separation by gravity settling.

In many operations, there is a need for effecting separation of solids from a liquid. Thus, for example, in U.S. Pat. No. 3,856,675, there is disclosed an improved process for separating insoluble material from a coal liquefaction product wherein such insoluble material is separated by gravity settling in the presence of a promoter liquid having specific characteristics. In such a process, and similar processes, there is a need for improved apparatus for effecting such gravity settling.

An object of the present invention is to provide for an improved liquid-solid separation by gravity settling.

A further object of the present invention is to provide for improved separation of insoluble material from a coal liquefaction product by gravity settling.

These and other objects of the present invention should become more readily apparent from reading the following detailed description thereof.

In accordance with one aspect of the present invention, there is provided a process for separating solids from a liquid by gravity settling wherein a liquid-solid mixture is introduced into a gravity settler at multiple locations and the settling paths of the solids are intercepted in the gravity settler by causing the solids to come into contact with intercepting surfaces to coalesce the solids and increase the solids settling rate with the intercepting surfaces being inverted V-shaped plates each formed from first and second downwardly inclined upwardly curved intersecting conical sections.

In accordance with another aspect of the present invention, there is provided gravity settler for effecting liquid-solid separation in which the gravity settler is provided with intercepting surfaces to intercept the settling path of the solids, with the intercepting surfaces being at least two vertically spaced inverted V-shaped plates, each formed from first and second downwardly inclined upwardly curved intersecting conical sections having their apices at the gravity settler wall. The plates form a gravity settling zone therebetween, and a fresh feed inlet means introduces solids dispersed in a liquid into the gravity settling zone. Each gravity settling zone is provided with an overflow outlet for withdrawing an essentially solids free liquid, and an underflow outlet for withdrawing solid containing liquid.

The invention will be further described with respect to the following drawings; wherein:

FIG. 1 is a simplified drawing of an embodiment of the gravity settler of the present invention; and FIG. 2 is a detailed view of the pipe connection for the embodiment of FIG. 2.

The gravity settler of the present invention is particularly suitable for separating insoluble material from a coal liquefaction product wherein the gravity settling is effected in the presence of a promoter liquid.

The coal liquefaction product is introduced into the gravity settler in admixture with a promoter liquid, as net feed, with the promoter liquid having the properties described in U.S. Pat. No. 3,856,675. As described in the aforementioned patent, the promoter liquid is one that has an aromaticity less than that of the liquefaction solvent and is generally a hydrocarbon liquid having a characterization factor (K) of at least about 9.75 and preferably at least about 11.0, with such characterization factor being an index of the aromaticity/-parafinicity of hydrocarbons and petroleum fractions as disclosed by Watson and Nelson, Ind. Eng. Chem. 25 880 (1933). The liquid which is used to enhance and promote the separation of insoluble material is further characterized by a 5 volume percent distillation temperature of at least about 250° F. and a 95 volume percent distillation temperature of at least about 350° F. and no greater than about 750° F. The promoter liquid preferably has a 5 volume percent distillation temperature of at least about 310° F. and most preferably of at least about 400° F. The 95 volume percent distillation temperature is preferably no greater than about 600° F. The most preferred promoter liquid has a 5 volume percent distillation temperature of at least about 425° F. and a 95 volume percent distillation temperature of no greater than about 500° F.

As representative examples of such liquids, there may be mentioned: kerosene or kerosene fraction from paraffinic or mixed base crude oils; middle distillates, light gas oils and gas oil fractions from paraffinic or mixed based crude oils; alkyl benzenes with side chains containing 10 or more carbon atoms; paraffinic hydrocarbons containing more than 12 carbon atoms; white oils or white oil fraction derived from crude oils; alpha-olefins containing more than 12 carbon atoms; fully hydrogenated naphthalenes and substituted naphthalenes; propylene oligomers (pentamer and higher); tetrahydronaphthalene, heavy naphtha fractions, etc. The most preferred liquids are kerosene fractions; white oils; fully hydrogenated naphthalenes and substituted naphthalenes.

The amount of liquid promoter used for enhancing and promoting the separation of insoluble matter from the coal liquefaction product will vary with the particular liquid employed, the coal liquefaction solvent, the coal used as starting material and the manner in which the liquefaction is effected. As should be apparent to those skilled in the art, the amount of liquid promoter used should be minimized in order to reduce the overall costs of the process. It has been found that by using the liquid of controlled aromaticity, the desired separation of insoluble material may be effected with modest amounts of liquid promoter. In general, the weight ratio of liquid promoter to coal solution may range from about 0.2:1 to about 3.0:1, preferably from about 0.3:1 to about 1.5:1. In using the preferred promoter liquid of the present invention which is a kerosene fraction having 5 percent and 95 percent volume distillation temperatures of 425° F. and 500° F. respectively, promoter liquid to coal solution weight ratios in the order of 0.4:1 to 0.6:1 have been particularly successful. It is to be understood, however, that greater amounts of liquid promoter may be employed, but the use of such greater amounts is uneconomical. In addition, the use of an excess of liquid promoter may result in the precipitation or separation of an excessive amount of desired coal derived products from the coal extract. More particularly, as the amount of liquid promoter employed is increased, a greater amount of ash is separated from the coal solution, but such an increased separation is accompanied by an increased separation of desired coal derived products from the coal solution. The net coal product (the extracted carbonaceous matter, excluding the promoter liquid, liquefaction solvent and gas make) contains less than about 1% insoluble material, generally less than 0.1% insoluble material, and most preferably less than 0.05% insoluble material, all by weight.

The gravity settling is generally effected at temperatures from about 300° F. to about 600° F., preferably from about 350° F. to about 500° F., and a pressure from about 0 psig to about 500 psig, preferably at a pressure from about 0 psig to about 300 psig. It is to be understood, however, that higher pressures could be employed, but as should be apparent to those skilled in the art, lower pressures are preferred.

Referring to FIG. 1, the A-shaped (inverted V-shaped) curved plates are formed from two upright conical sections 301 and 302 having the respective apexes 303 and 304 positioned at the vessel wall. The conical sections 301 and 302 are arranged such that they intersect with each other in the interior of the vessel above the cone apexes to form a curved or saddle-like intersection 305, with apexes 303 and 304 of the respective conical sections 301 and 302 being spaced 180° from each other. Thus, the internal plates are defined by the intersection of two vertical conical sections and the vessel (preferably a cylindrical vessel), with the apex of each cone being spaced on the vessel wall 180° from each other.

The vessel is provided with at least two vertically spaced intersecting conical sections, with a liquid-solid separation compartment or chamber 307 therebetween. The chamber 307 has two portions **307*a* and 307*b* defined between vertically spaced conical sections 301 and 302**, respectively.

Each of the portions **307*a* and 307*b* is provided with an underflow outlet 309 and 311, respectively, positioned at the apex of the respective conical section, with a combined overflow being withdrawn through an apertured overflow outlet pipe 312 which extends across the vessel and is positioned immediately below the saddle-like intersection of the next higher intersecting conical sections. Each of the portions 307*a* and 307*b* is provided with a feed inlet in the form of apertured inlet pipes 314 and 315, respectively, which extend across the vessel at an intermediate portion of each of the portions 307*a* and 307*b***.

Each of the inlet pipes, and outlet pipes may be connected to the vessel wall through a suitable bayonet type connection, as shown in FIG. 5A.

In operation, the gravity settler functions as described with respect to the embodiment of FIG. 1, with liquid-solid feed being introduced into portion **307*a* through feed pipe 314 and into portion 307*b* through feed pipe 315. The solids which are intercepted by plates 301 and 302 are withdrawn through outlets 309 and 311, respectively. Solid free overflow is withdrawn through outlet pipe 312**.

The use of conical section plates 301 and 302 offers the advantage that all surfaces are sloped towards the underflow withdrawal at the cone apex, which minimizes solid hangup. In addition, the curved shape provides additional mechanical strength, which should eliminate the need for stiffening members.

Although the present invention is particularly suitable for effecting liquid-solid separation of solid particulate material from a coal liquefaction product, it is to be understood that the present invention is suitable for effecting any one of a wide variety of liquid-solid mixtures by gravity settling. Thus, for example, the gravity settler of the present invention may also be employed for the removal of char fines from oils produced from pyrolysis of coals; finely dispersed solid particles in kerogen retorted from shale, tar sands, oil shale, and the like. The use of gravity settling in accordance with the invention for these applications and others should be apparent to those skilled in the art from the teachings herein.

Numerous modifications and variations of the present invention are possible in light of the above teachings and, therefore, within the scope of the appended claims, the invention may be practiced otherwise than as particularly described.

What is claimed is:

1. A process for separating solids from a liquid by gravity settling, comprising:

introducing a liquid containing dispersed solids into a gravity settler at multiple locations;

intercepting the settling paths of the solids below each of the feed locations by bringing the solids into contact with inclined intercepting surfaces which divide the gravity settler into separate separation zones to thereby coalesce the solids and increase the solids settling rate, said inclined, intersecting surfaces being at least two vertically spaced, inverted V-shaped plates, each formed of first and second downwardly inclined, upwardly curved, intersecting conical sections having their apices at the vessel wall and defining a substantially enclosed separation zone therebetween;

recovering a solids containing underflow from the separate separation zones; and recovering an essentially solids free overflow from the separation zones.

2. The process of claim 1 wherein liquid containing dispersed solids is a coal liquefaction product.

3. The process of claim 2 wherein the coal liquefaction product includes a promoter liquid which promotes and enhances the separation of solids.

4. A gravity settler for effecting solid-liquid separation, comprising:

a vessel; at least two vertically spaced V-shaped plates, each formed of first and second downwardly inclined, upwardly curved, intersecting conical sections having their apices at the vessel wall and defining a substantially enclosed chamber therebetween;

inlet means for introducing a liquid-solid feed between the at least two vertically spaced plates; underflow outlet means for withdrawing solid containing underflow from the chamber at each of the apices of the conical sections; and overflow outlet means for withdrawing overflow from an upper portion of the chamber.

5. The settler of claim 4 wherein the inlet means is comprised of first and second inlet pipes for introducing feed into first and second portions of the chamber defined between vertically spaced conical sections.

6. The settler of claim 5 wherein the apices of the conical sections are spaced by 180° on the vessel wall.

7. The settler of claim 6 wherein the conical sections have a saddle intersection.

* * * * *